US008903116B2

(12) United States Patent
Norris

(10) Patent No.: US 8,903,116 B2
(45) Date of Patent: Dec. 2, 2014

(54) PARAMETRIC TRANSDUCERS AND RELATED METHODS

(75) Inventor: Elwood G. Norris, Poway, CA (US)

(73) Assignee: Turtle Beach Corporation, Poway, CA (US)

( * ) Notice: Subject to any disclaimer, the term of this patent is extended or adjusted under 35 U.S.C. 154(b) by 212 days.

(21) Appl. No.: 13/160,051

(22) Filed: Jun. 14, 2011

(65) Prior Publication Data

US 2012/0148082 A1 Jun. 14, 2012

Related U.S. Application Data

(60) Provisional application No. 61/354,533, filed on Jun. 14, 2010, provisional application No. 61/445,195, filed on Feb. 22, 2011.

(51) Int. Cl.

| | |
|---|---|
| ***H04R 1/02*** | (2006.01) |
| ***H04R 1/42*** | (2006.01) |
| ***H01F 19/04*** | (2006.01) |
| ***H04R 9/04*** | (2006.01) |
| ***H01F 3/08*** | (2006.01) |
| *H04R 25/00* | (2006.01) |
| *H04R 3/00* | (2006.01) |

(52) U.S. Cl.

CPC .. *H04R 1/42* (2013.01); *H04R 3/00* (2013.01); *H01F 19/04* (2013.01); *H04R 9/04* (2013.01); *H01F 3/08* (2013.01)

USPC ..... 381/353; 381/189; 381/191

(58) Field of Classification Search

CPC ..... H04R 19/00; H04R 19/01; H04R 19/13; H04R 17/005; H04R 17/025; H04R 2499/11; H04R 2499/13; H04R 2499/15

USPC ..... 381/190, 191, 363, 189, 111, 113, 116, 381/173, 174, 176, 306, 333, 388

See application file for complete search history.

(56) References Cited

U.S. PATENT DOCUMENTS

| | | | |
|---|---|---|---|
| 1,616,639 | A | 2/1927 | Sprague |
| 1,764,008 | A | 6/1930 | Crozier |
| 1,799,053 | A | 3/1931 | Mache |

(Continued)

FOREIGN PATENT DOCUMENTS

| | | |
|---|---|---|
| JP | H2265400 | 10/1990 |
| WO | WO01/08449 | 2/2001 |

(Continued)

OTHER PUBLICATIONS

PCT Application PCT/US2011/04388; filed Jun. 14, 2011; Elwood G. Norris; International Search Report mailed Dec. 26, 2011.

(Continued)

*Primary Examiner* — Curtis Kuntz
*Assistant Examiner* — Sunita Joshi
(74) *Attorney, Agent, or Firm* — Thorpe North & Western LLP

(57) ABSTRACT

An audio emitter comprises a support member operable to support a sound emittive material and a sound emittive material carried by the support member. A protective screen has a plurality of apertures formed therein, the protective screen being spaced a predetermined distance from the sound emittive material, said predetermined distance being a function of a resonant frequency of the audio emitter.

20 Claims, 6 Drawing Sheets

(56) References Cited

U.S. PATENT DOCUMENTS

| | | | |
|---|---|---|---|
| 1,809,754 | A | 6/1931 | Steedle |
| 1,951,669 | A | 3/1934 | Ramsey |
| 1,983,377 | A | 12/1934 | Kellogg |
| 2,461,344 | A | 2/1949 | Olson |
| 2,855,467 | A | 10/1958 | Curry |
| 2,872,532 | A | 2/1959 | Buchmann et al. |
| 2,935,575 | A | 5/1960 | Bobb |
| 2,975,243 | A | 3/1961 | Katella |
| 2,975,307 | A | 3/1961 | Schroeder et al. |
| 3,008,013 | A | 11/1961 | Williamson et al. |
| 3,012,222 | A | 12/1961 | Hagemann |
| 3,136,867 | A | 6/1964 | Brettell |
| 3,345,469 | A | 10/1967 | Rod |
| 3,373,251 | A | 3/1968 | Seeler |
| 3,389,226 | A | 6/1968 | Peabody |
| 3,398,810 | A | 8/1968 | Clark, III |
| 3,461,421 | A | 8/1969 | Stover |
| 3,544,733 | A | 12/1970 | Reylek |
| 3,612,211 | A | 10/1971 | Clark, III |
| 3,613,069 | A | 10/1971 | Cary, Jr. |
| 3,654,403 | A | 4/1972 | Bobb |
| 3,674,946 | A | 7/1972 | Winey |
| 3,710,332 | A | 1/1973 | Tischner et al. |
| 3,723,957 | A | 3/1973 | Damon |
| 3,742,433 | A | 6/1973 | Kay et al. |
| 3,787,642 | A | 1/1974 | Young, Jr. |
| 3,816,774 | A | 6/1974 | Ohnuki et al. |
| 3,821,490 | A | 6/1974 | Bobb |
| 3,829,623 | A | 8/1974 | Willis et al. |
| 3,833,771 | A | 9/1974 | Collinson |
| 3,836,951 | A | 9/1974 | Geren et al. |
| 3,892,927 | A | 7/1975 | Lindenberg |
| 3,919,499 | A | 11/1975 | Winey |
| 3,941,946 | A | 3/1976 | Kawakami et al. |
| 3,997,739 | A | 12/1976 | Kishikawa et al. |
| 4,056,742 | A | 11/1977 | Tibbetts |
| 4,064,375 | A | 12/1977 | Russell et al. |
| 4,160,882 | A | 7/1979 | Driver |
| 4,207,571 | A | 6/1980 | Passey |
| 4,210,786 | A | 7/1980 | Winey |
| 4,242,541 | A | 12/1980 | Ando |
| 4,245,136 | A | 1/1981 | Krauel, Jr. |
| 4,284,921 | A | 8/1981 | Lemonon et al. |
| 4,289,936 | A | 9/1981 | Civitello |
| 4,295,214 | A | 10/1981 | Thompson |
| 4,322,877 | A | 4/1982 | Taylor |
| 4,378,596 | A | 3/1983 | Clark |
| 4,385,210 | A | 5/1983 | Marquiss |
| 4,418,404 | A | 11/1983 | Gordon et al. |
| 4,419,545 | A | 12/1983 | Kuindersma |
| 4,429,193 | A | 1/1984 | Busch-Vishniac et al. |
| 4,439,642 | A | 3/1984 | Reynard |
| 4,471,172 | A | 9/1984 | Winey |
| 4,480,155 | A | 10/1984 | Winey |
| 4,514,773 | A | 4/1985 | Susz |
| 4,550,228 | A | 10/1985 | Walker et al. |
| 4,558,184 | A | 12/1985 | Busch-Vishniac et al. |
| 4,593,160 | A | 6/1986 | Nakamura |
| 4,593,567 | A | 6/1986 | Isselstein et al. |
| 4,672,591 | A | 6/1987 | Breimesser et al. |
| 4,695,986 | A | 9/1987 | Hossack |
| 4,751,419 | A | 6/1988 | Takahata |
| 4,803,733 | A | 2/1989 | Carver et al. |
| 4,823,908 | A | 4/1989 | Tanaka et al. |
| 4,837,838 | A | 6/1989 | Thigpen et al. |
| 4,872,148 | A | 10/1989 | Kirby et al. |
| 4,885,781 | A | 12/1989 | Seidel |
| 4,887,246 | A | 12/1989 | Hossack et al. |
| 4,888,086 | A | 12/1989 | Hossack et al. |
| 4,903,703 | A | 2/1990 | Igarashi et al. |
| 4,908,805 | A | 3/1990 | Sprenkels et al. |
| 4,939,784 | A | 7/1990 | Bruney |
| 4,991,148 | A | 2/1991 | Gilchrist |
| 5,018,203 | A | 5/1991 | Sawyers et al. |
| 5,054,081 | A | 10/1991 | West |
| 5,115,672 | A | 5/1992 | McShane et al. |
| 5,142,511 | A | 8/1992 | Kanai et al. |
| 5,153,859 | A | 10/1992 | Chatigny et al. |
| 5,287,331 | A | 2/1994 | Schindel et al. |
| 5,317,543 | A | 5/1994 | Grosch |
| 5,357,578 | A | 10/1994 | Taniishi |
| 5,361,381 | A | 11/1994 | Short |
| 5,392,358 | A | 2/1995 | Driver |
| 5,430,805 | A | 7/1995 | Stevenson et al. |
| 5,487,114 | A | 1/1996 | Dinh |
| 5,539,705 | A | 7/1996 | Akerman et al. |
| 5,638,456 | A | 6/1997 | Conley et al. |
| 5,684,884 | A | 11/1997 | Nakaya et al. |
| 5,700,359 | A | 12/1997 | Bauer |
| 5,859,915 | A | 1/1999 | Norris |
| 5,885,129 | A | 3/1999 | Norris |
| 5,889,870 | A | 3/1999 | Norris |
| 6,011,855 | A | 1/2000 | Selfridge et al. |
| 6,041,129 | A | 3/2000 | Adelman |
| 6,106,399 | A | 8/2000 | Baker et al. |
| 6,108,427 | A | 8/2000 | Norris et al. |
| 6,151,398 | A | 11/2000 | Norris |
| 6,188,772 | B1 | 2/2001 | Norris et al. |
| 6,229,899 | B1 | 5/2001 | Norris et al. |
| 6,241,612 | B1 | 6/2001 | Heredia |
| 6,304,662 | B1 | 10/2001 | Norris et al. |
| 6,411,015 | B1 | 6/2002 | Toda |
| 6,498,531 | B1 | 12/2002 | Ulrick et al. |
| 6,556,687 | B1 | 4/2003 | Manabe |
| 6,584,205 | B1 | 6/2003 | Croft, III et al. |
| 6,606,389 | B1 | 8/2003 | Selfridge et al. |
| 6,628,791 | B1 | 9/2003 | Bank et al. |
| 6,631,196 | B1 | 10/2003 | Higgins |
| 6,775,388 | B1 | 8/2004 | Pompei |
| 6,914,991 | B1 | 7/2005 | Pompei |
| 6,975,731 | B1 | 12/2005 | Cohen et al. |
| 7,162,042 | B2 | 1/2007 | Spencer et al. |
| 7,369,665 | B1 | 5/2008 | Cheng |
| 7,564,981 | B2 | 7/2009 | Croft, III |
| 7,596,229 | B2 | 9/2009 | Croft, III |
| 7,657,044 | B2 | 2/2010 | Pompei |
| 7,667,444 | B2 | 2/2010 | Mavay et al. |
| 7,729,498 | B2 | 6/2010 | Spencer et al. |
| 7,850,526 | B2 | 12/2010 | Mao |
| 7,957,163 | B2 | 6/2011 | Hua |
| 8,027,488 | B2 | 9/2011 | Pompei |
| 8,106,712 | B2 | 1/2012 | Lee |
| 8,165,328 | B2 | 4/2012 | Thomsen |
| 8,391,514 | B2 | 3/2013 | Norris |
| 2004/0052387 | A1* | 3/2004 | Norris et al. ..... 381/190 |
| 2005/0008168 | A1* | 1/2005 | Pompei ..... 381/77 |
| 2005/0008268 | A1* | 1/2005 | Plourde et al. ..... 383/207 |
| 2005/0086058 | A1 | 4/2005 | Lemelson et al. |
| 2005/0100181 | A1 | 5/2005 | Croft, III et al. |
| 2005/0152561 | A1 | 7/2005 | Spencer |
| 2005/0195985 | A1 | 9/2005 | Croft, III et al. |
| 2005/0220311 | A1 | 10/2005 | Sun |
| 2006/0025214 | A1 | 2/2006 | Smith |
| 2006/0215841 | A1 | 9/2006 | Vieilledent |
| 2007/0154035 | A1 | 7/2007 | Fukui |
| 2007/0211574 | A1 | 9/2007 | Croft, III |
| 2008/0261693 | A1 | 10/2008 | Zalewski |
| 2010/0016727 | A1 | 1/2010 | Rosenberg |
| 2010/0040249 | A1 | 2/2010 | Lenhardt |
| 2010/0414447 | | 2/2010 | Graylin |
| 2010/0166222 | A1 | 7/2010 | Bongiovi |
| 2011/0018710 | A1 | 1/2011 | Booij et al. |
| 2011/0051977 | A1 | 3/2011 | Losko et al. |
| 2011/0077080 | A1 | 3/2011 | Meer |
| 2011/0103614 | A1 | 5/2011 | Cheung et al. |
| 2011/0212777 | A1 | 9/2011 | Chen |
| 2011/0216928 | A1 | 9/2011 | Eisenberg et al. |
| 2012/0051556 | A1 | 3/2012 | Pompei |
| 2012/0057734 | A1 | 3/2012 | Schulein |
| 2012/0014082 | A1 | 4/2012 | Norris |
| 2012/0148070 | A1 | 6/2012 | Norris |
| 2014/0161282 | A1 | 6/2014 | Norris |

(56) References Cited

U.S. PATENT DOCUMENTS

FOREIGN PATENT DOCUMENTS

| | | |
|---|---|---|
| WO | WO01/15491 | 3/2001 |
| WO | WO01/52437 | 7/2001 |
| WO | WO 2008/046175 A1 | 4/2008 |
| WO | WO2013/158298 | 10/2013 |

OTHER PUBLICATIONS

U.S. Appl. No. 13/160,065, filed Jun. 14, 2011; Elwood G. Norris; notice of allowance dated Dec. 17, 2012.
U.S. Appl. No. 13/761,484, filed Feb. 7, 2013; Elwood G. Norris.
U.S. Appl. No. 13/837,237, filed Mar. 15, 2013; Elwood G. Norris.
PCT/US13/32214; filed Mar. 15, 2013; Elwood G. Norris.
PCT/US13/32214; filed Mar. 15, 2013; Norris.
U.S. Appl. No. 13/837,237, filed Mar. 15, 2013; Norris.
U.S. Appl. No. 13/761,484, filed Feb. 7, 2013; Norris.
U.S. Appl. No. 13/160,048, filed Jun. 14, 2011; Elwood G. Norris.
U.S. Appl. No. 13/160,065, filed Jun. 14, 2011; Elwood G. Norris.
Aoki et al; Parametric Loudspeaker—Characteristics of Acoustic Field and Suitable Modulation of Carrier Ultrasound, Electronics and Communications in Japan, Part 3, vol. 74, No. 9, 1991, pp. 76-82.
Berktay et al; Possible Exploitation of Non-Linear Acoustics in Underwater Transmitting Applications, J. Sound Vib., Apr. 13, 1965, vol. 2, No. 4, pp. 435-461.
Crandall et al; The Air-Damped Vibrating System: Theoretical Calibration of the Condenser Transmitter; American Physical Society; Dec. 28, 1917; pp. 449-460.
Makarov et al; Parametric Acoustic Nondirectional Radiator; Acustica; 1992; vol. 77, pp. 240-242.
PCT Application PCT/US2013/021064; Filed Jan. 10, 2013; Parametric Sound Corporation; International Search Report Mailed May 16, 2013.
U.S. Appl. No. 13/738,887, filed Jan. 10, 2013; Elwood G. Norris.
U.S. Appl. No. 13/863,971, filed Apr. 16, 2013; Elwood G. Norris.
U.S. Appl. No. 13/917,315, filed Jun. 13, 2013; Elwood G. Norris.
U.S. Appl. No. 13/935,246, filed Jul. 3, 2013; Elwood G. Norris.
Wagner; Electrostatic Loudspeaker Design and Construction; Audio Amateur Press Publishers; 1993; Chapters 4-5; pp. 59-91.
Westervelt; Parametric Acoustic Array; The Journal of the Acoustical Society of America; Apr. 1963; vol. 35, No. 1, pp. 535-537.
Yoneyama et al.; The Audio Spotlight: An Application of Nonlinear Interaction of Sound Waves to a New Type of Loudspeaker Design; Acoustical Society of America; 1983; vol. 73, No. 5; pp. 1532-1536.
U.S. Appl. No. 13/160,048, filed Jun. 14, 2011; Elwood G. Norris; office action dated Oct. 1, 2013.
U.S. Appl. No. 13/917,273, filed Jun. 13, 2013; Elwood G. Norris.
U.S. Appl. No. 13/761,484, filed Feb. 7, 2013; Elwood G. Norris; Office action issued Nov. 4, 2013.
U.S. Appl. No. 13/761,484, filed Feb. 7, 2013; Elwood G. Norris; office issued Nov. 4, 2013.
PCT Application PCT/US2014/018691; filed Mar. 26, 2014; Parametric Sound Corporation; International Search report mailed Jun. 6, 2014.

* cited by examiner

PARAMETRIC TRANSDUCERS AND RELATED METHODS

PRIORITY CLAIM

Priority is claimed of U.S. Provisional Patent Application Ser. No. 61/354,533, filed Jun. 14, 2010, and of U.S. Provisional Patent Application Ser. No. 61/445,195, filed Feb. 22, 2011, each of which is hereby incorporated herein by reference in its entirety.

RELATED CASES

This application is related to U.S. patent application Ser. No. 13/160,048, filed Jun. 14, 2011, titled Improved Parametric Signal Processing Systems and Methods, and is related to U.S. patent application Ser. No. 13/160,065, filed Jun. 14, 2011, titled Improved Parametric Transducer Systems and Related Methods.

BACKGROUND OF THE INVENTION

1. Field of the Invention

The present invention relates generally to the field of parametric loudspeakers for use in audio production.

2. Related Art

Non-linear transduction, such as a parametric array in air, results from the introduction of sufficiently intense, audio modulated ultrasonic signals into an air column. Self demodulation, or down-conversion, occurs along the air column resulting in the production of an audible acoustic signal. This process occurs because of the known physical principle that when two sound waves with different frequencies are radiated simultaneously in the same medium, a modulated waveform including the sum and difference of the two frequencies is produced by the non-linear (parametric) interaction of the two sound waves. When the two original sound waves are ultrasonic waves and the difference between them is selected to be an audio frequency, an audible sound can be generated by the parametric interaction.

While the theory of non-linear transduction has been addressed in numerous publications, commercial attempts to capitalize on this intriguing phenomenon have largely failed. Most of the basic concepts integral to such technology, while relatively easy to implement and demonstrate in laboratory conditions, do not lend themselves to applications where relatively high volume outputs are necessary. As the technologies characteristic of the prior art have been applied to commercial or industrial applications requiring high volume levels, distortion of the parametrically produced sound output has resulted in inadequate systems.

Whether the emitter is a piezoelectric emitter or PVDF film or electrostatic emitter, in order to achieve volume levels of useful magnitude, conventional systems often required that the emitter be driven at intense levels. These intense levels have often been greater than the physical limitations of the emitter device, resulting in high levels of distortion or high rates of emitter failure, or both, without achieving the magnitude required for many commercial applications.

Efforts to address these problems include such techniques as square rooting the audio signal, utilization of Single Side Band ("SSB") amplitude modulation at low volume levels with a transition to Double Side Band ("DSB") amplitude modulation at higher volumes, recursive error correction techniques, etc. While each of these techniques has proven to have some merit, they have not separately or in combination allowed for the creation of a parametric emitter system with high quality, low distortion and high output volume. The present inventor has found, in fact, that under certain conditions some of the techniques described above actually cause more measured distortion than does a basic system of like components without the presence of these prior art techniques.

SUMMARY OF THE INVENTION

In accordance with one aspect of the invention, an audio emitter is provided, including a support member operable to support a sound emittive material, and a sound emittive material carried by the support member. A protective screen can have a plurality of apertures formed therein, the protective screen being spaced a predetermined distance from the sound emittive material, said predetermined distance being a function of a resonant frequency of the audio emitter.

In accordance with another aspect of the invention, a method of increasing output of an audio emitter that includes a sound emittive material and a protective screen is provided, the method including: calculating a predetermined distance at which the protective screen is spaced from the sound emittive material such that operation of the emitter creates standing acoustic waves between a face of the sound emittive material and an opposing face of the protective screen to thereby enhance a resonant frequency at which the emitter operates.

In accordance with another aspect of the invention, a method of increasing output of an audio emitter having a sound emittive material and a protective screen is provided, the method including: adjusting an acoustic impedance of an airspace between a face of the sound emittive material and an opposing face of the protective screen by adjusting a predetermined distance at which the face of the sound emittive material and the opposing face of the protective screen are spaced from one another to thereby enhance a resonant frequency at which the emitter operates; and fixing the protective screen at the predetermined distance from the sound emittive material.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
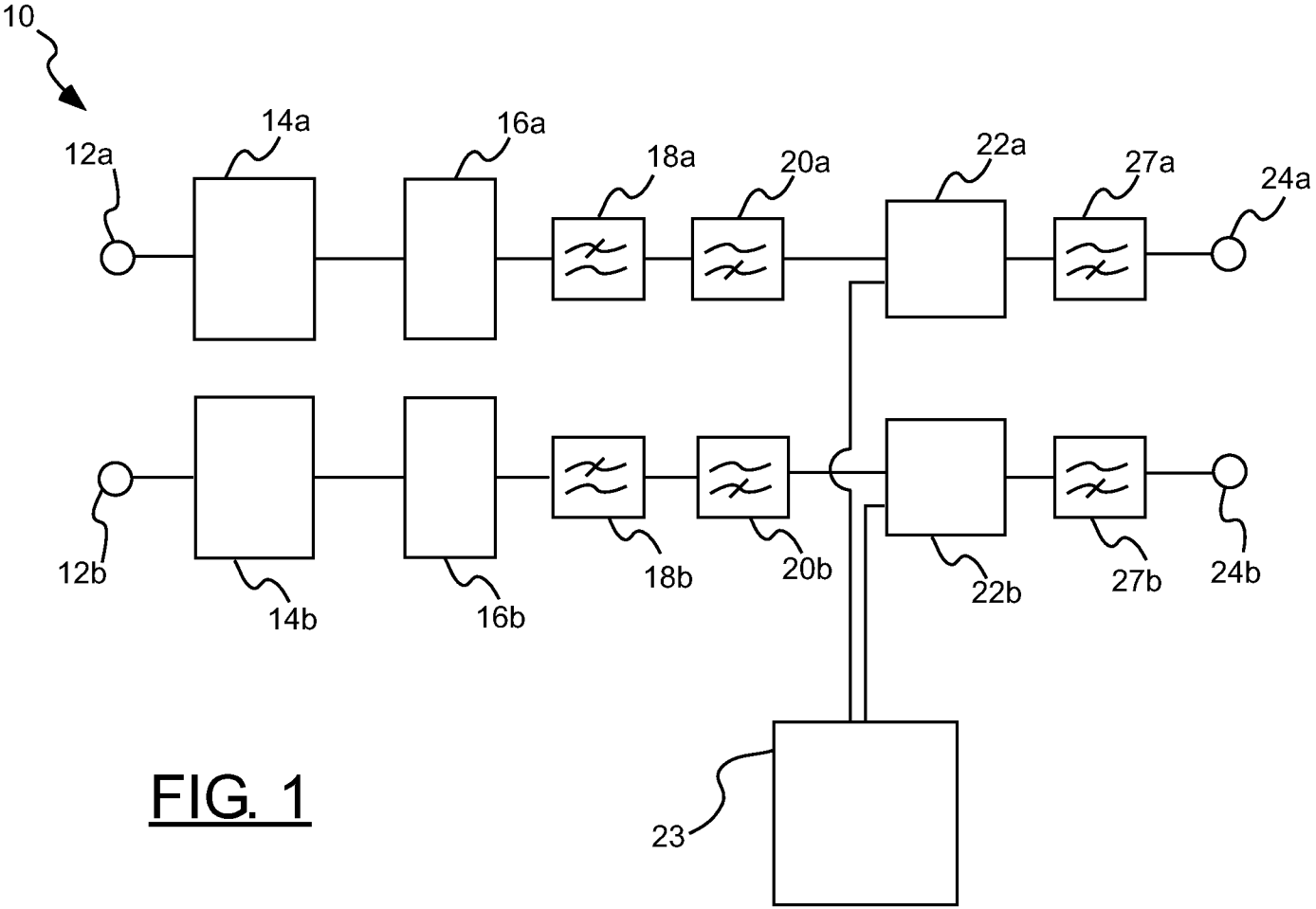
FIG. 1 is a block diagram of an exemplary signal processing system in accordance with one embodiment of the invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

DEFINITIONS

As used herein, the singular forms "a" and "the" can include plural referents unless the context clearly dictates otherwise. Thus, for example, reference to "an emitter" can include one or more of such emitters.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present invention relates to improved audio emitter configurations for use in a variety of audio applications. More specifically, the emitters disclosed herein have proven exceptionally effective for use in parametric sound systems. The emitters described herein have proven to be much more efficient than conventional emitters (creating greater output with far less power consumption), while also providing sound quality never before achieved with parametric emitter systems. The audio emitters discussed herein can be used with a variety of signal processing systems that are typically suitable for use in providing one or more ultrasonic signals to one or more emitters in order to deliver parametric audio output. While any number of signal processing systems can be utilized with the present emitters, an exemplary signal processing system 10 is presented in detail as one example of a suitable signal processing system.

One exemplary, non-limiting signal processing system 10 in accordance with the present invention is illustrated schematically in FIG. 1. In this embodiment, various processing circuits or components are illustrated in the order (relative to the processing path of the signal) in which they are arranged according to one implementation of the invention. It is to be understood that the components of the processing circuit can vary, as can the order in which the input signal is processed by each circuit or component. Also, depending upon the embodiment, the processing system 10 can include more or fewer components or circuits than those shown.

Also, the example shown in FIG. 1 is optimized for use in processing multiple input and output channels (e.g., a "stereo" signal), with various components or circuits including substantially matching components for each channel of the signal. It is to be understood that the system can be equally effectively implemented on a single signal channel (e.g., a "mono" signal), in which case a single channel of components or circuits may be used in place of the multiple channels shown.

Referring now to the exemplary embodiment shown in FIG. 1, a multiple channel signal processing system 10 can include audio inputs that can correspond to left 12*a* and right 12*b* channels of an audio input signal. Compressor circuits 14*a*, 14*b* can compress the dynamic range of the incoming signal, effectively raising the amplitude of certain portions of the incoming signals and lowering the amplitude of certain other portions of the incoming signals resulting in a narrower range of audio amplitudes. In one aspect, the compressors lessen the peak-to-peak amplitude of the input signals by a ratio of not less than about 2:1. Adjusting the input signals to a narrower range of amplitude is important to minimize distortion which is characteristic of the limited dynamic range of this class of modulation systems.

Figure 2:
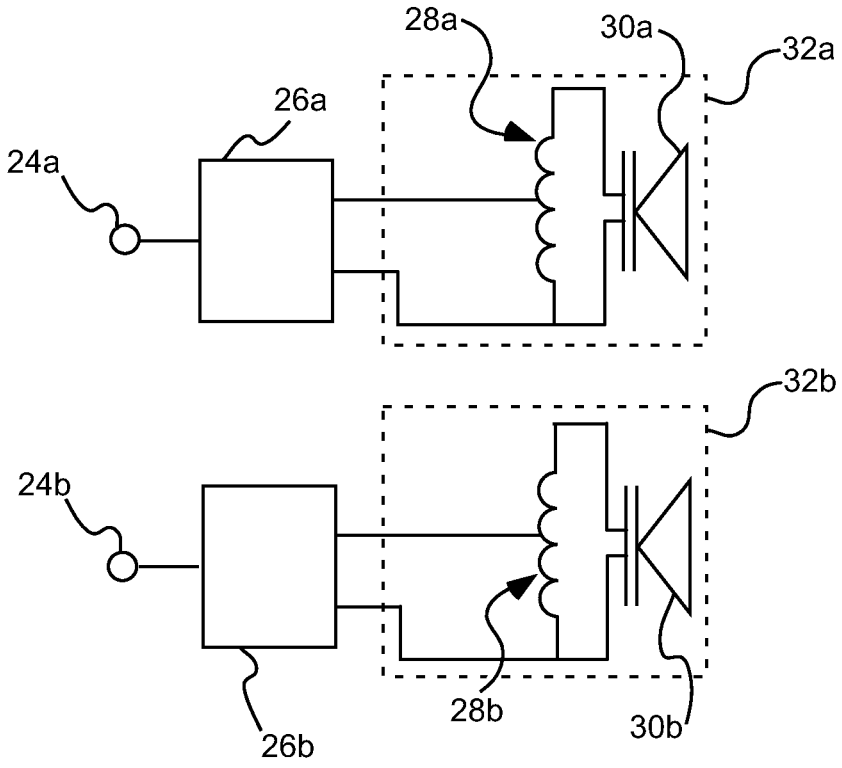
FIG. 2 is a block diagram of an exemplary amplifier and emitter arrangement in accordance with an embodiment of the invention.

After the audio signals are compressed, equalizing networks 16*a*, 16*b* can provide equalization of the signal. The equalization networks can advantageously boost lower frequencies to increase the benefit provided naturally by the emitter/inductor combination of the parametric emitter assembly 32*a*, 32*b* (FIG. 2).

Low pass filter circuits 18*a*, 18*b* can be utilized to provide a hard cutoff of high portions of the signal, with high pass filter circuits 20*a*, 20*b* providing a hard cutoff of low portions of the audio signals. In one exemplarily embodiment of the present invention, low pass filters 18*a*, 18*b* are used to cut signals higher than 15 kHz, and high pass filters 20*a*, 20*b* are used to cut signals lower than 200 Hz (these cutoff points are exemplary and based on a system utilizing an emitter having on the order of 50 square inches of emitter face).

Figure 6:
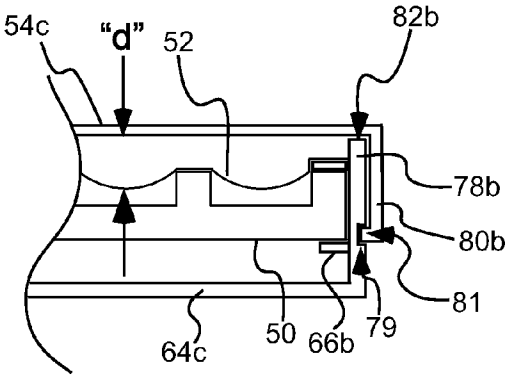
FIG. 6 is a partial, schematic end view of another configuration of the emitter of FIG. 3.

The high pass filters 20*a*, 20*b* can advantageously cut low frequencies that, after modulation, result in nominal deviation of carrier frequency (e.g., those portions of the modulated signal of FIG. 6 that are closest to the carrier frequency). These low frequencies are very difficult for the system to reproduce efficiently (as a result, much energy can be wasted trying to reproduce these frequencies), and attempting to reproduce them can greatly stress the emitter film (as they would otherwise generate the most intense movement of the emitter film).

The low pass filter can advantageously cut higher frequencies that, after modulation, could result in the creation of an audible beat signal with the carrier. By way of example, if a low pass filter cuts frequencies above 15 kHz, with a carrier frequency of around 44 kHz, the difference signal will not be lower than around 29 kHz, which is still outside of the audible range for humans. However, if frequencies as high as 25 kHz were allowed to pass the filter circuit, the difference signal generated could be in the range of 19 kHz, which is well within the range of human hearing.

In the exemplary embodiment shown, after passing through the low pass and high pass filters, the audio signals are modulated by modulators 22*a* and 22*b*, where they are combined with a carrier signal generated by oscillator 23. While not so required, in one aspect of the invention, a single oscillator (which in one embodiment is driven at a selected frequency of 40 kHz to 50 kHz, which range corresponds to readily available crystals that can be used in the oscillator) is used to drive both modulators 22*a*, 22*b*. By utilizing a single oscillator for multiple modulators, an identical carrier frequency is provided to multiple channels being output at 24*a*, 24*b* from the modulators. This aspect of the invention can negate the generation of any audible beat frequencies that might otherwise appear between the channels while at the same time reducing overall component count.

While not so required, in one aspect of the invention, high-pass filters 27*a*, 27*b* can be included after modulation that serve to filter out signals below about 25 kHz. In this manner, the system can ensure that no audible frequencies enter the amplifier via outputs 24*a*, 24*b*. In this manner, only the modulated carrier wave is fed to the amplifier(s), with any audio artifacts being removed prior to the signal being fed to the amplifier(s).

Thus, the signal processing system 10 receives audio input at 12*a*, 12*b* and processes these signals prior to feeding them to modulators 22*a*, 22*b*. An oscillating signal is provided at 23, with the resultant outputs at 24*a*, 24*b* then including both a carrier (typically ultrasonic) wave and the audio signals that are being reproduced, typically modulated onto the carrier wave. The resulting signal(s), once emitted in a non-linear medium such as air, produce highly directional parametric sound within the non-linear medium.

For more background on the basic technology behind the creation of an audible wave via the emission of two ultrasonic waves, the reader is directed to numerous patents previously issued to the present inventor, including U.S. Pat. Nos. 5,889,870 and 6,229,899, which are incorporated herein by reference to the extent that they are consistent with the teachings herein. Due to numerous subsequent developments made by the present inventor, these earlier works are to be construed as subordinate to the present disclosure in the case any discrepancies arise therebetween.

The signal processing system can advantageously produce output that can be connected to and used by a variety of emitter types. In one example, an ESMR film emitter has been found to be particularly effective. Some exemplary, conventional ESMR film emitters are discussed in U.S. Patent Publication No. 20050100181, which is hereby incorporated herein by reference to the extent it is consistent with the teachings herein (however, the earlier work is to be construed as subordinate to the present disclosure in the case that any discrepancies exist therebetween).

Figure 3:
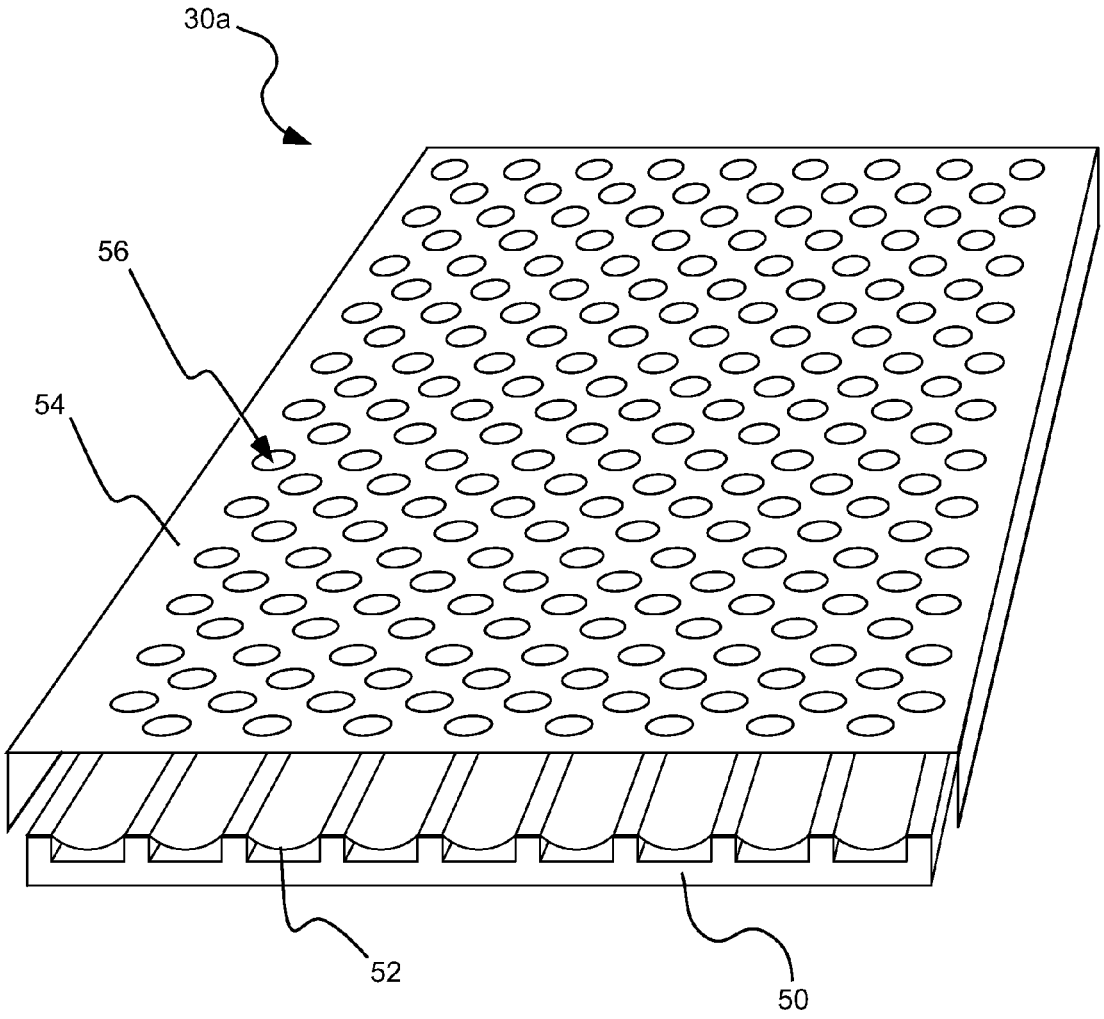
FIG. 3 is a schematic perspective view of an exemplary emitter in accordance with an embodiment of the invention.
Figure 4:
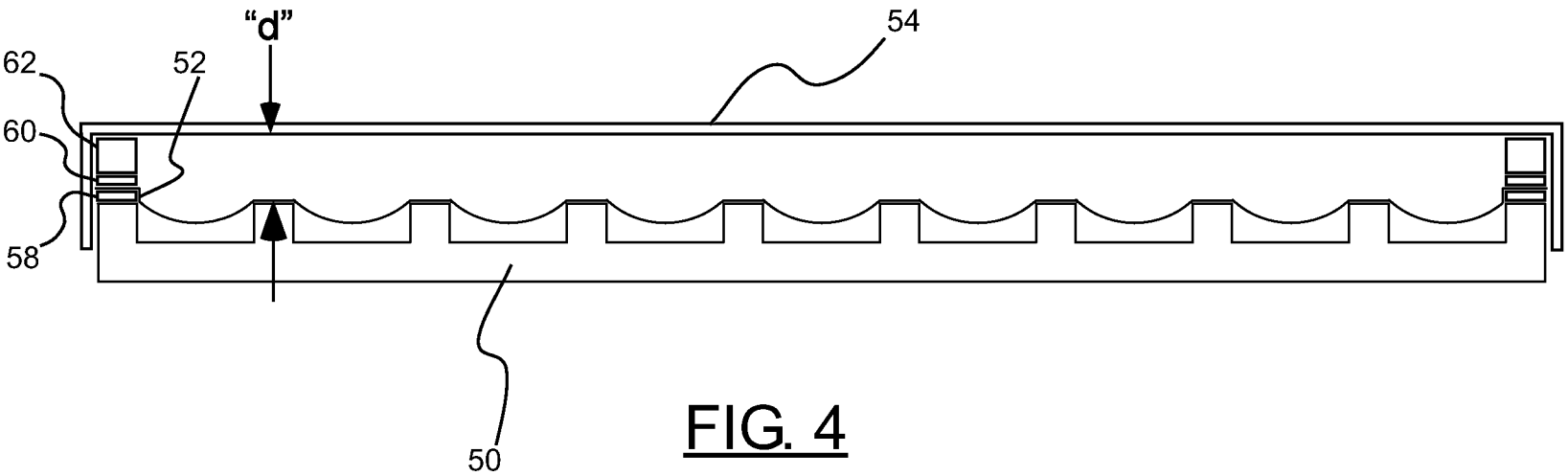
FIG. 4 is a schematic end view of one embodiment of the emitter of FIG. 3.

One specific exemplary emitter provided by the present system is illustrated generally at 30*a* in FIG. 3 and in more detail in FIG. 4. In this aspect of the invention, a support member 50 can include a sound emittive material (such as an ESMR film) 52 attached thereto. When provided with a signal from the signal processing system 10 (not shown in these figures), the sound emittive material propagates a parametric sound wave generated as discussed above, resulting in the formation of a highly directional sound column (not shown in detail in the drawings). A protective screen or cover 54 can be positioned over the sound emittive material to protect the material from inadvertent contact by users as well as dramatically increase output due to strategic spacing of the protective screen from the sound emittive material. The protective screen or cover 54 can include a series of apertures 56 that allow the parametric wave to pass through the protective screen while increasing the output level emitted.

As will be readily appreciated by one of ordinary skill in the art, while protective screens or covers can be desirable (or even required) to protect both users of the product and the emittive film itself, the presence of a protective cover or screen has, in the past, had a negative impact on the output of the emitter unit. Such as result has been expected, as the protective screen interferes, in one way or another, with the operation of the emitter as it was designed. However, the present inventor has developed a protective screen system that does not negatively impact output of the emitter unit, and, due to the reinforcing action of standing waves, actually increases the output of the emitter without introducing distortion or other negative sound qualities.

As shown by example in FIG. 4, in one aspect of the invention, the protective screen or cover 54 can be purposefully spaced from the sound emittive film 52 by a distance "d" that is a function of the resonant frequency of the emitter. By carefully controlling this distance "d," the present inventor has developed an emitter system (including a cover or protective screen) that has measured output that is substantially higher than that emitted by the system without the use of a cover screen.

While the spacing "d" of the screen relative to the emitter can vary, in one aspect the spacing is equal to one wavelength of the resonant frequency. In the case where the resonant frequency is designed at 40 kHz, for example, this spacing is about 0.337 inches (measured from the inside of the screen to the face of the emittive film). An emitter having a protective cover or screen thusly positioned has measurably increased output. It is believed that this spacing enhances the output of the emitter due to the creation of standing waves between the film and the screen.

In addition to increasing the amplitude of the output of the emitter, controlling the spacing of the protective screen from the emitter film can also greatly reduce distortion in the output signal. In one aspect of the invention, the spacing of the protective screen can be varied to adjust an acoustic impedance of the airspace between the protective screen and the emitter face. More specifically, it is believed that the acoustic impedance of the airspace immediately adjacent the emitter face is altered by controlled spacing of the protective screen to more closely match the acoustic impedance of the emittive film. It is believed that this result is achieved due to loading the airspace with acoustic energy that is deflected back to the emitter face by the portions of the screen that block sound rather than allow it to pass through the screen (e.g., the solid portions of the screen that are not apertures).

In this manner, the output of the emittive film is stabilized, leading to a considerable decrease in distortion of the sound produced by the emitter. In one aspect of the invention, this effect is also functionally related to spacing the screen in increments of the wavelength of the resonant frequency of the emitter. For example, this effect seems most pronounced when the spacing is one wavelength of the resonant frequency, and/or fractions thereof (e.g., ¼ wavelength, ½ wavelength, ¾ wavelength, etc.).

It has also been found that varying the diameter of the apertures 56 can also positively affect the output of the emittive film. In one example, forming the apertures with a diameter of about one-half of a wavelength of the resonant frequency is optimal. Apertures having diameters of other fractional measures of the wavelength of the resonant frequency can also be utilized. Also, while the apertures shown in FIG. 3 are generally circular, they can be formed in more slot-like (e.g., oval) configurations is so desired. Also, the apertures can vary from the example shown in relative spacing one from another: they can be spaced further or closer to one another than is illustrated in the example figure.

The spacing of the protective screen or cover 54 can be accomplished in a number of manners. In the exemplary embodiment shown in FIG. 4, spacers 62 can be installed on each edge of the emitter face to maintain the protective screen at the specified distance "d" from the emittive film face. The spacers 62 can include conductors 60 formed on a lower face thereof that can provide electrical connection to one face of the emittive material. Another conductive strip 58 can be installed beneath the emittive material to provide electrical connection for that side of the emittive material. Thus, a solid electrical connection can be made with the emittive material across substantially an entire length of the material.

The spacers 62 can be formed from a variety of materials. In the event the conductive strips are in contact with the spacer, however, the spacer is best formed from a non-conductive material such as wood, plastic, etc. (or coated or insulated with a non-conductive material).

Figure 5:
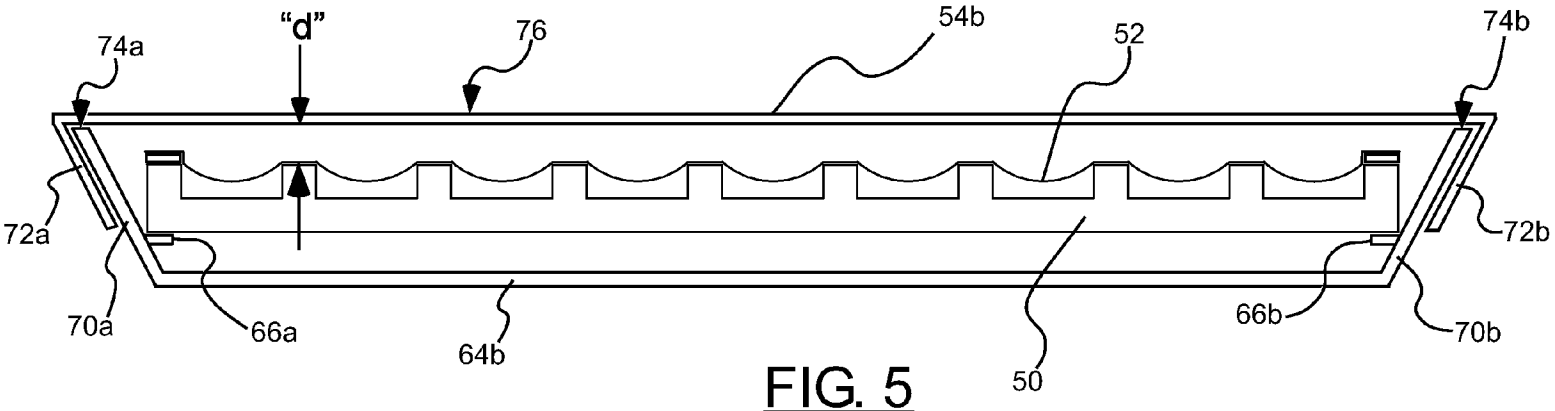
FIG. 5 is a schematic end view of another configuration of the emitter of FIG. 3.

FIG. 5 illustrates another manner in which the protective screen or cover 54*b* can be maintained or retained at the predetermined position "d." In this embodiment, the support member 50 is attached within a housing 64*b*. Attachment of the support member is shown by example utilizing shoulders 66*a*, 66*b*, but any number of attachment schemes could be utilized to couple the support member to or within the housing. In the embodiment shown, the housing includes a pair of upwardly and outwardly angled sidewalls 70*a*, 70*b*. The protective cover or screen 54*b* can include a pair of downwardly and inwardly angled sidewalls 72*a*, 72*b*. The angles of the respective sidewalls can correspond to one another, such that the protective screen or cover is securely retained against edges 74*a*, 74*b* of the housing 64*b* when the sidewalls are engaged with one another. In this manner, once the protective cover or screen is installed over the housing, the distance "d" is maintained.

Installation of the protective cover or screen 54*b* over (or to) the housing 64*b* can be accomplished in a number of manners. In one aspect, the cover or screen can be slid longitudinally relative to the housing to engage the housing while the sidewalls 70*a*, 72*a* and 70*b*, 72*b*, respectively, engage one another. Locking means (not shown), such as indentations or "snap-fit" locations, can be utilized to fix the cover or screen in a desired position over the housing once the cover or screen has been slid into the desired position. In another aspect, the sidewalls of the cover or screen can be "snap fit" over the sidewalls of the housing to secure the cover or screen in place. As will be appreciated by one of ordinary skill in the art having possession of this disclosure, the exact angle from which the sidewalls vary from a frontal face 76 of the protective screen or cover is not critical. However, the angle should vary sufficiently from ninety degrees such that the protective cover or screen is not easily dislodged from the housing.

Turning now to FIG. 6, another exemplary configuration of housing 64*c* and protective screen 54*c* is illustrated (only one edge of the configuration is shown, the opposing edge can be a mirror image of the edge shown). In this aspect of the invention, sidewall 78*b* of the housing includes an indentation 79. Sidewall 80*b* of the protective screen or cover includes a protrusion 81. To install the protective screen or cover over the housing, the protrusion 81 can be "snap fit" into the indentation 79 to secure and retain the cover or screen at the predetermined distance "d." The indentation and protrusion can extend longitudinally substantially fully along the edge of the housing, or only partially along the edge. In some aspects of the invention, multiple indentations can be distributed longitudinally along sidewall 78*b* and multiple protrusions can be distributed longitudinally along sidewall 80*b*.

In addition, while the embodiment shown includes at least one indentation 79 in sidewall 78*b* of the housing 64*c* (with a corresponding protrusion 81 in the sidewall 80*b* of the protective screen or cover 54*c*), it is to be understood that the positioning of the indentation and protrusion can be interchanged. That is, the sidewall 78*b* could be provided with a protrusion and sidewall 80*b* could be provided with an indentation.

Figure 7:
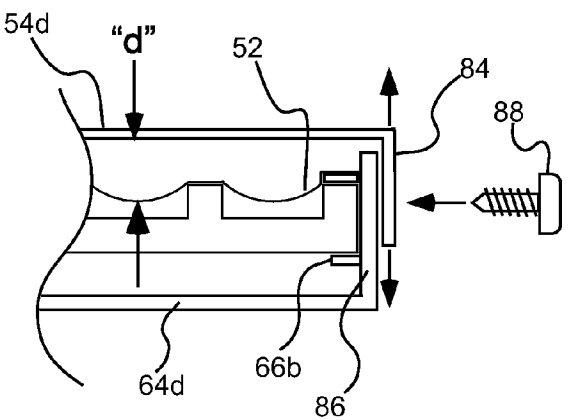
FIG. 7 is a partial, schematic end view of another configuration of the emitter of FIG. 3.

In the embodiment illustrated in FIG. 7, protective cover 54*d* can slide freely over housing 64*d*, with sidewall 84 sliding relative to sidewall 86. Once the desired separation distance "d" is created, fastener 88 can be utilized to fix the protective cover or screen relative to one another.

While the various fastening schemes illustrated in FIGS. 5, 6 and 7 are shown independently of one another, it is to be understood that more than one type of fastening scheme can be utilized to secure and retain the protective cover to the housing. For example, the angled sidewalls of FIG. 5 could be utilized along with the protrusion/indention scheme of FIG. 6 and, if desired, a mechanical fastener could be utilized to secure the assembly to prevent inadvertent movement of the protective screen or cover relative to the housing.

Figure 8A:
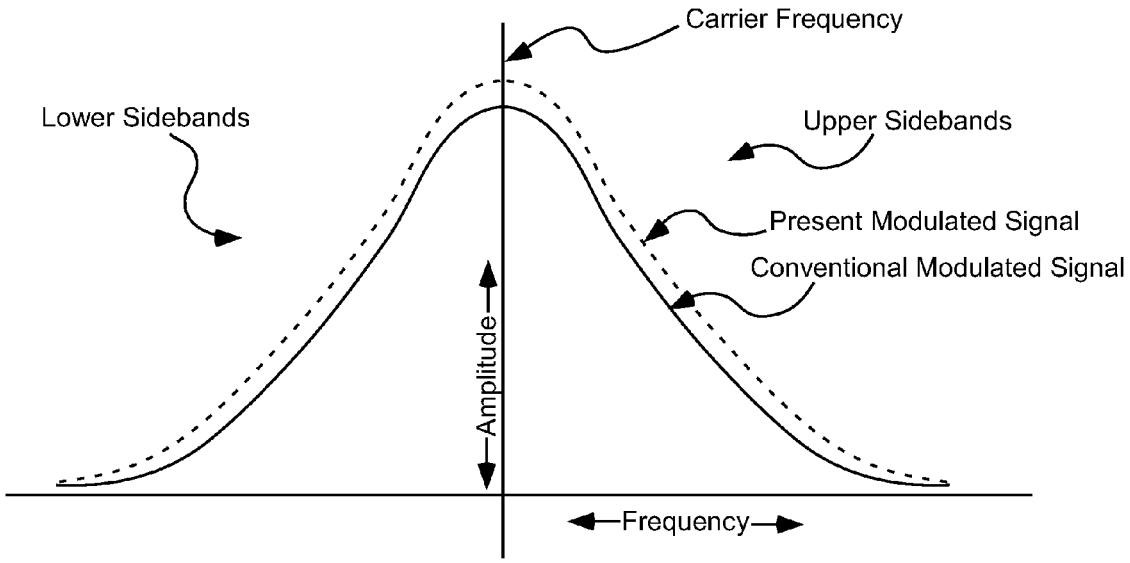
FIG. 8A is a frequency response curve of a typical signal generated by a conventional signal processing system, shown with an improved frequency response curve (having increased amplitude) of the present invention overlaid thereon.
Figure 8B:
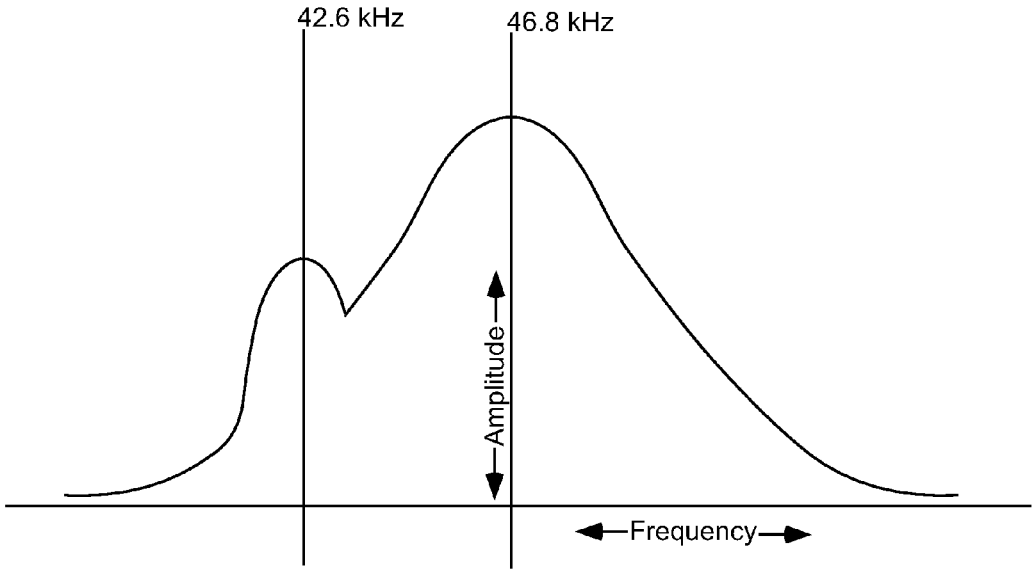
FIG. 8B is a graphical representation of one manner of strategically selecting a frequency of standing waves created by purposeful spacing of the protective screen from the emitter face in accordance with an embodiment of the invention.

FIGS. 8A and 8B illustrate advantages provided by the present invention. In FIG. 8A, the frequency characteristic of a conventional signal generator is shown, which can, for example, be 40 kHz resonant frequency. During operation, upper and lower sidebands are generated as a result of double sideband amplitude modulation of the carrier by an audio input signal. Shown overlaid thereon is the frequency characteristic of a signal generated by the present invention. By the strategic spacing of the screen 54 (as illustrated in FIGS. 4, 5, 6 and 7) in front of the emitter, the overall amplitude of the system is substantially increased relative to a conventional signal output, with no corresponding increase in the power input required.

FIG. 8B illustrates graphically one manner of selecting the spacing distance of the protective screen from the emitter film face. As an example, the natural resonant frequency of the emitter can be established at 46.8 kHz (this is a factor solely of the physical configuration of the emitter). The peak of 46.8 kHz shown in FIG. 8B is theoretically the frequency characteristic at which the emitter should operate. However, as soon as power is applied to the emitter film, it heats up slightly (as does any capacitive material), and causes the resonant operating frequency to shift downward (to the peak of 42.6 kHz shown in FIG. 8B). With the present system, this shift happens about five-to-ten seconds after applying power to the emitter.

In one embodiment of the present invention, the screen spacing ("d" in FIGS. 4, 5 6 and 7) is chosen so that standing waves are created at the location of the frequency to which the response curve moves after warming up (e.g., to 42.6 kHz in the example shown). The creation of standing waves at the operating resonant frequency of the system increases the magnitude of the output of the system as shown in FIG. 8A. This purposeful spacing results in measured increase in output of as much as 5-6 dB.

The system described above can provide numerous advantages over conventional systems. Due to the increase in sound output and quality, and the ability to precisely process stereo inputs, two emitters can be used together to produce true binaural sound quality without requiring the use of headphones (as all conventional binaural systems do).

The power requirements for the present system are drastically reduced from those of prior art systems. The present signal processing system can be driven by a simple power supply and consumes as little as 22 watts per channel at peak usage. Conventional systems often consume 130 watts at peak usage, and can range from 80-130 watts during continual use. Despite this reduced power requirement, the present system has been measured to output several times the volume of conventional systems.

The distortion levels produced by the present system are considerably lower than conventional systems. Some such systems have been measured to produce 50%-80% distortion. The present system measures less than about 30% distortion, which is a significant improvement over conventional units.

While not so required, in one aspect of the invention, a capacitor (not shown) having a negative temperature coefficient can be coupled across the emittive film in parallel with the film. In this manner, as the temperature of the emitter increases during use, the coefficient of the capacitor decreases, thereby maintaining a relatively constant frequency response by the emitter.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

I claim:

1. An audio emitter, comprising:

a support member operable to support a sound emittive material;

a sound emittive material carried by the support member, the sound emittive material having a front face and a rear face, the rear face supported by the support member; and a protective screen having a plurality of apertures formed therein;

the protective screen being separated from the front face of the sound emittive material by an airspace, the airspace extending across the front face of the sound emittive material between the sound emittive material and the protective screen;

the protective screen being spaced by the airspace a predetermined distance from the sound emittive material, said predetermined distance being a function of a resonant frequency of the audio emitter.

2. The emitter of claim 1, wherein the predetermined distance is a fraction of a wavelength of the resonant frequency of the emitter.

3. The emitter of claim 2, wherein the predetermined distance is about 1 wavelength of the resonant frequency of the emitter.

4. The emitter of claim 2, wherein the predetermined distance is about 1/32, 1/16, 1/8, 1/4, 1/2 or 3/4 of a wavelength of the resonant frequency of the emitter.

5. The emitter of claim 1, wherein at least some of the apertures include a diameter of about one-half a wavelength of a resonant frequency of the emitter.

6. The emitter of claim 1, wherein the sound emittive material carried by the support member is mounted within a housing, and wherein the protective screen is retained at the predetermined distance from the sound emittive material by engaging structure of the housing.

7. The emitter of claim 6, wherein the housing includes a pair of sidewalls and the protective screen includes a pair of sidewalls, and wherein the sidewalls of the housing engage the sidewalls of the protective screen to thereby retain the protective screen at the predetermined distance from the sound emittive material.

8. The emitter of claim 7, wherein the sidewalls of the housing and the sidewalls of the protective screen are substantially parallel to one another and form an oblique angle to a frontal face of the protective screen.

9. The emitter of claim 7, wherein one of the sidewalls of the housing or the sidewalls of the protective screen includes an indentation, and wherein an other of the sidewalls of the housing or the sidewalls of the protective screen includes a protrusion, and wherein the protrusion engages the indentation to retain the protective screen at the predetermined distance.

10. The emitter of claim 7, wherein a position of the protective screen relative to the housing can be adjusted, and further comprising a fastener to secure the protective screen to the housing once positioned at the predetermined distance.

11. A method of increasing output of an audio emitter that includes a sound emittive material and a protective screen, comprising:

calculating a predetermined distance at which the protective screen is spaced by an airspace from the sound emittive material such that operation of the emitter creates standing acoustic waves in the airspace between a face of the sound emittive material and an opposing face of the protective screen to thereby enhance a resonant frequency at which the emitter operates; wherein the protective screen is spaced from the sound emittive material such that the airspace extends across the face of the sound emittive material.

12. The method of claim 11, wherein the predetermined distance is a fraction of a wavelength of the resonant frequency of the emitter.

13. The method of claim 12, wherein the predetermined distance is about 1 wavelength of the resonant frequency of the emitter.

14. The method of claim 12, wherein the predetermined distance is about 1/32, 1/16, 1/8, 1/4, 1/2 or 3/4 of a wavelength of the resonant frequency of the emitter.

15. The method of claim 11, wherein the protective screen includes a plurality of apertures formed therethrough, and wherein at least some of the apertures include a diameter of about one-half a wavelength of a resonant frequency of the emitter.

16. A method of increasing output of an audio emitter having a sound emittive material and a protective screen, comprising:

adjusting an acoustic impedance of an airspace between a face of the sound emittive material and an opposing face of the protective screen by adjusting a predetermined distance at which the face of the sound emittive material and an opposing face of the protective screen are spaced from one another by the airspace to thereby enhance a resonant frequency at which the emitter operates; and fixing the protective screen at the predetermined distance from the sound emittive material to maintain the airspace extending across the opposing face of the sound emittive material.

17. The method of claim 16, wherein the predetermined distance is a fraction of a wavelength of the resonant frequency of the emitter.

18. The method of claim 17, wherein the predetermined distance is about 1 wavelength of the resonant frequency of the emitter.

19. The method of claim 17, wherein the predetermined distance is about 1/32, 1/16, 1/8, 1/4, 1/2 or 3/4 of a wavelength of the resonant frequency of the emitter.

20. The method of claim 16, wherein the protective screen includes a plurality of apertures formed therethrough, and wherein at least some of the apertures include a diameter of about one-half a wavelength of a resonant frequency of the emitter.

* * * * *